US007455066B2

(12) United States Patent
Feddema et al.

(10) Patent No.: US 7,455,066 B2
(45) Date of Patent: Nov. 25, 2008

(54) DISHWASHER UTENSIL RACK AND UTENSIL BASKET THEREFOR

(75) Inventors: Mark Steven Feddema, Benton Harbor, MI (US); Rud J. Lauer, Hartford, MI (US); Jeffrey Ray Taylor, St. Joseph, MI (US); Lorraine J. Westlake, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 603 days.

(21) Appl. No.: 11/092,453

(22) Filed: Mar. 29, 2005

(65) Prior Publication Data

US 2006/0219271 A1 Oct. 5, 2006

(51) Int. Cl.
*B08B 3/04* (2006.01)

(52) U.S. Cl. ..... 134/56 D

(58) Field of Classification Search ..... 134/56 D
See application file for complete search history.

(56) References Cited

U.S. PATENT DOCUMENTS

| | | | | |
|---|---|---|---|---|
| 3,556,625 A | | 1/1971 | Kauffman | 312/301 |
| 5,086,544 A | | 2/1992 | Huttemann et al. | 211/41 |
| 5,242,222 A | * | 9/1993 | Michael | 312/334.45 |
| 5,462,348 A | * | 10/1995 | Ellingson et al. | 312/301 |
| D481,179 S | | 10/2003 | Wendt et al. | D32/3 |
| 2003/0226580 A1 | | 12/2003 | Welch | 134/172 |
| 2006/0250058 A1 | * | 11/2006 | Stevens et al. | 312/311 |

FOREIGN PATENT DOCUMENTS

| | | |
|---|---|---|
| DE | 4437472 | 4/1996 |
| EP | 0186157 | 12/1985 |
| GB | 993999 | 6/1965 |
| GB | 2349330 | 11/2000 |
| JP | 2004105269 | 4/2004 |

OTHER PUBLICATIONS

European Search Report EP 06251253.8 Dated Jan. 8, 2006.

* cited by examiner

*Primary Examiner*—Frankie L. Stinson
*Assistant Examiner*—Samuel A Waldbaum
(74) *Attorney, Agent, or Firm*—John Morrison; Michael D. LaFrenz

(57) ABSTRACT

An automatic dishwasher comprises an open-faced cabinet defining a wash chamber and a utensil rack mounted within the wash chamber. The utensil rack comprises a frame mounted to the cabinet and a basket removably mounted to the frame, and the frame and the basket are configured such that the basket is vertically adjustable relative to the frame. Additionally, the basket comprises a plurality of basket elements that are complementary to form a whole basket. Further, the dishwasher includes a pair of slides for slidably mounting the frame to the cabinet. The slides comprise a track that slidably receives a wheel on the utensil rack and includes an access opening for insertion or removal of the wheel from the track. A closure for selectively closing the access opening prevents undesired removal of the wheel from the track.

30 Claims, 13 Drawing Sheets

DISHWASHER UTENSIL RACK AND UTENSIL BASKET THEREFOR

BACKGROUND OF THE INVENTION

1. Field of the Invention

The invention relates generally to a utensil rack for use with a household dishwasher and a utensil basket supported by the utensil rack. In one aspect, the invention relates to a utensil rack adapted to hold a utensil basket in multiple vertical positions. In another of its aspects, the invention relates to a utensil rack having multiple basket elements that are complementary to form a whole basket. In yet another of its aspects, the invention relates to a utensil rack mounted to the dishwasher by a pair of slides having a closure member to prevent undesired removal of the utensil rack from the slides.

2. Description of the Related Art

Automatic dishwashers are well known, especially those for use in household environments. A typical automatic dishwasher comprises a cabinet that defines a washing chamber, which is accessible through a moveable door. Typically, an upper and a lower rack for holding utensils to be cleaned are provided within the washing chamber. A silverware basket is also usually provided and normally mounts to the lower rack. The upper and lower racks are normally spaced so that larger utensils can be positioned in the lower rack and smaller utensils in the upper rack. Both the upper and lower racks are slidably mounted within the washing chamber in such a manner that at least a major portion of the racks can be slid substantially beyond the washing chamber to ease the loading of the racks.

The types of utensils placed in an automatic dishwasher can vary greatly in size. Some utensils are very large, such as soup pots and roasting pans, other utensils are relatively small, such as silverware, serving spoons, and spatulas. The racks must also accommodate the traditional utensils of plates, glasses, saucer plates, mugs, etc. Since the utensil composition can vary greatly from load to load, contemporary automatic dishwashers must be configured or easily adaptable to accommodate these various size utensils to maximize the number of utensils washed during a given load. The maximization of the number of utensils in each load is a great convenience for the user and also reduces energy and water consumption.

The shapes of some utensils are such that they can reduce the effective holding capacity of the automatic dishwasher, and thereby increase the need for multiple loads, resulting in an inefficient use of resources. An example of such a utensil is any utensil having a long and slender profile, such as a wooden spoon, a spatula, a ladle, etc. Often times, the length of these utensils makes it impossible for them to stand up within the silverware basket because the utensil will contact the other rack. To wash these types of utensils, it is necessary to lay them down in either the upper or lower racks where they often extend across a substantial portion of the rack floor. Unfortunately their slender profile leaves quite a significant volume of rack space above such a utensil. Since for best cleaning it is not desirable to place other items on top of the elongated utensils, the space above the elongated utensils is not often used, thereby effectively reducing the capacity of the given load. The laid down slender profile utensils are also more likely than large profile utensils to fall through the spaced between the intersecting ribs forming the bottom of the racks, where the slender profile utensils can interfere with the rotating spray arms and other structures of the dishwasher.

Smaller utensils with a slender profile, such as table knives, spoons, and forks, can also take up more space than is warranted if they are placed on one of the racks. This is why they are commonly positioned upright in the silverware basket. Usually, the height of the silverware basket is about half the length or less of these smaller utensils. As a result, the smaller utensils tend to lean against the edges of the silverware basket and against one another, especially when the utensils are crowded in silverware basket, which can detrimentally affect the ability of the dishwasher to clean the utensils, especially at the interface of the utensils with the basket or other utensils.

Thus, it is desirable to have an automatic dishwasher that can efficiently accommodate all shapes and sizes of utensils for effective cleaning thereof without dramatically sacrificing overall capacity.

Another problem associated with conventional dishwasher racks relates to the slides that mount the racks to the side walls of the dishwasher cabinet. Usually, the racks include wheels or similar devices mounted to the sides thereof, and the wheels ride within a slide movably mounted to the cabinet. To remove the rack from the dishwasher, the user pulls the rack out of the wash chamber by sliding the wheel toward the end of the slide and, once the rack reaches the end of the slide, removes the wheels from the slide, usually by slightly lifting the rack to lift the wheel over a detent in the slide while continuing to pull. However, with such a configuration, it is easy for the user to accidentally pull the wheel over the detent while pulling the rack out of the wash chamber in a normal fashion and thereby unintentionally remove the rack from the slide. It is therefore desirable to have an automatic dishwasher with a slide that prevents undesired removal of the rack therefrom.

SUMMARY OF THE INVENTION

According to one embodiment of the invention, a utensil rack for use in an automatic dishwasher comprising an open-faced cabinet defining a wash chamber and a door movably mounted to the cabinet for selectively closing the wash chamber comprises a frame mounted to the cabinet; and a basket removably mounted to the frame; wherein the frame and the basket are configured such that the basket can be mounted to the frame in a first position and a second position, and when the basket is in the second position, it is located higher in the wash chamber than when the basket is in the first position.

According to another embodiment of the invention, a utensil rack for use in an automatic dishwasher comprising an open-faced cabinet defining a wash chamber and a door movably mounted to the cabinet for selectively closing the wash chamber comprises a frame mounted to the cabinet and having a periphery that defines an area; and a plurality of basket elements removably mounted to the frame; wherein the basket elements are complementary to form a whole basket having a surface area that is slightly less than the area of the frame.

DESCRIPTION OF THE PREFERRED EMBODIMENT

Figure 1:
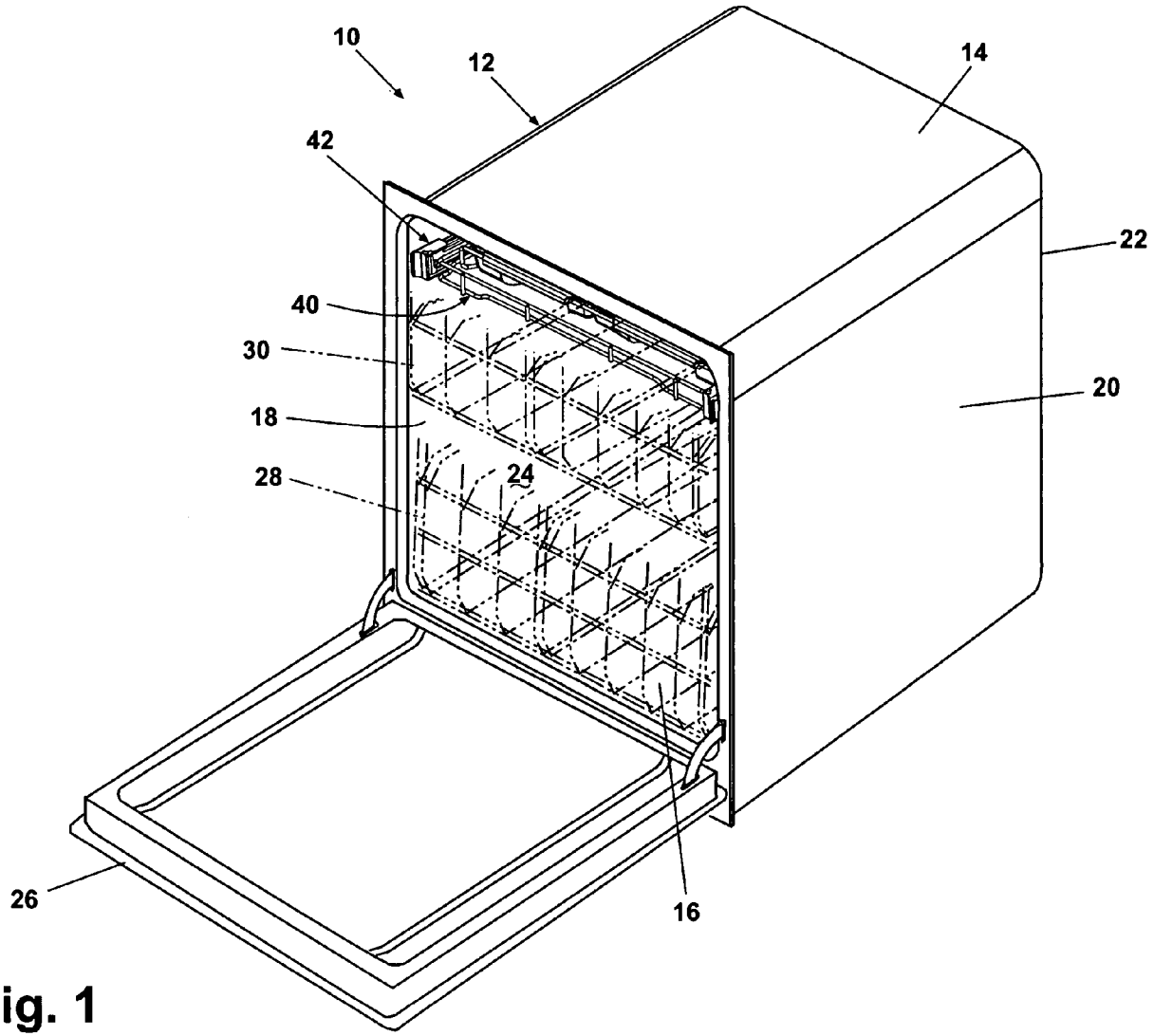
FIG. 1 is a perspective view of a household dishwasher according to one embodiment of the invention comprising two conventional utensil racks and a third utensil rack positioned within a wash chamber of the dishwasher, wherein the third utensil rack is mounted to the dishwasher by a pair of slides and comprises a frame that supports a pair of basket elements, which are shown in an upper position on the frame.

Referring now to the figures, FIG. 1 shows a household dishwasher 10 according to one embodiment of the invention comprising a cabinet 12 having spaced upper and lower walls 14, 16 joined by opposing side walls 18, 20 and a rear wall 22 to form an open-faced wash chamber 24. A door 26 movably mounted to the cabinet 12 is movable between an open position, as shown in FIG. 1, wherein the user can access the wash chamber 24, and a closed position, wherein the door 26 closes the open face of the wash chamber 24 in a conventional fashion. The dishwasher 10 further comprises a lower, first utensil rack 28 and a higher, second utensil rack 30 slidably mounted the side walls 18, 20 of the cabinet 12. The first and second utensil racks 28, 30 are preferably conventional utensil racks commonly utilized in present day household dishwashers for holding various utensils, such as plates, bowls, other tableware, and beverage containers. Usually, the first utensil rack 28 is adapted to hold plates, bowls, and large items, such as pots and pans, and the second utensil rack 30 is spaced a sufficient distance above the first utensil rack 28 to accommodate the items in the first utensil rack 30. The second utensil rack 30 commonly holds beverage containers, such as glasses and cups, and other small items. However, the first and second utensil racks 28, 30 can be arranged in the dishwasher 10 in any suitable fashion and can hold any utensils that can be washed in the dishwasher 10. During operation of a wash cycle of the dishwasher 10, the door 26 is in the closed position, and the first and second utensil racks 28, 30 are disposed within the wash chamber 24 and exposed to washing fluid, such as water, and wash aids, such as detergents and rinse aids. When dishwasher 10 is not operating, the user can move the door 26 to the open position and slide the first and second utensil racks 28, 30 from the wash chamber to empty or fill the first and the second utensil racks 28, 30.

Figure 2:
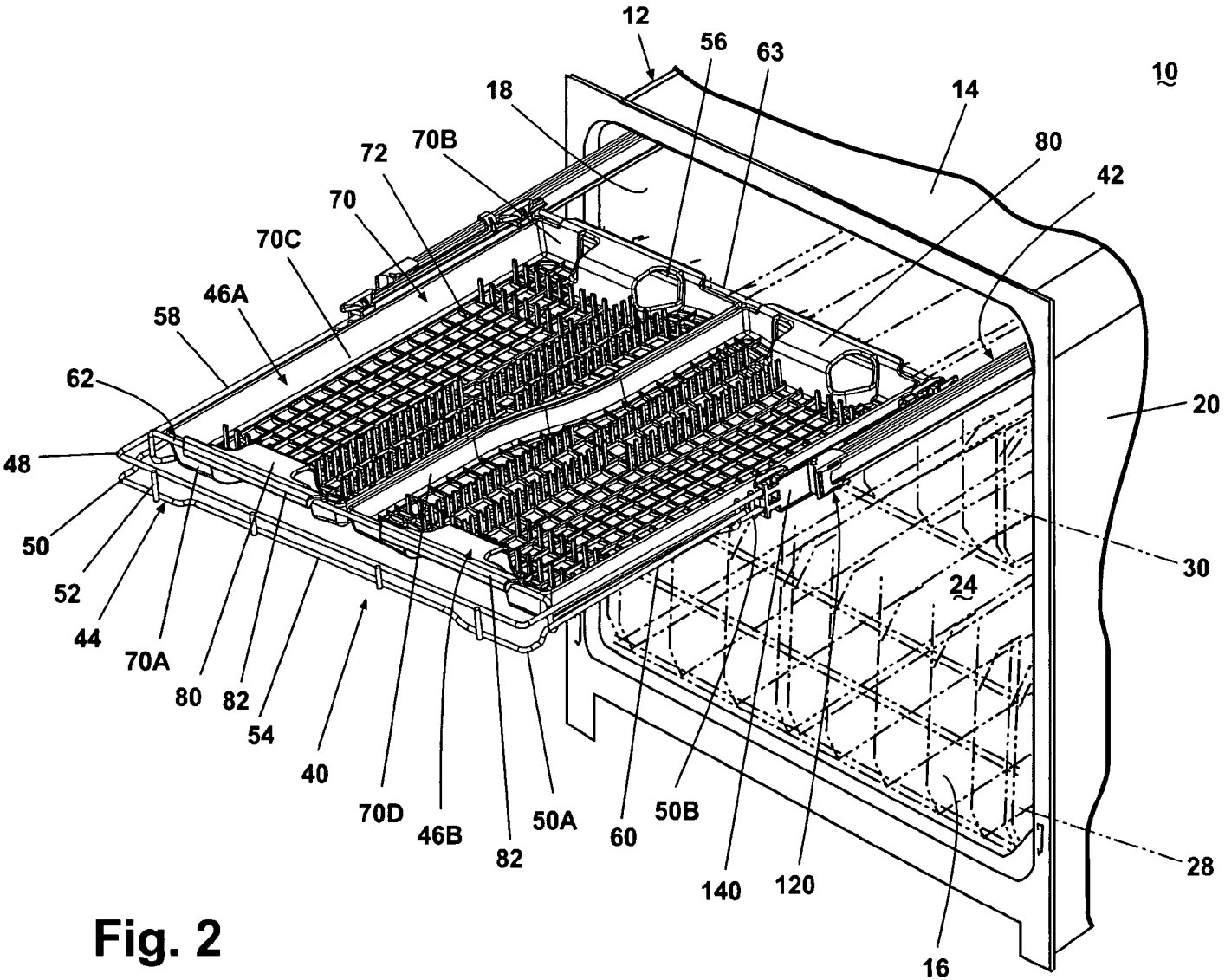
FIG. 2 is a perspective view of the dishwasher of FIG. 1 with the third utensil rack according to one embodiment of the invention slid exteriorly from the wash chamber.

As shown in FIG. 2, according to one embodiment of the invention, the dishwasher 10 can further comprise a third utensil rack 40 slidably mounted to the cabinet 12 by a pair of slides 42. The third utensil rack 40 can be positioned above the second utensil rack 30 and near the upper wall 14 within the wash chamber 24 and can move relative to the wash chamber 24 in the same manner as described above for the first and second utensil racks 28, 30. The third utensil rack 40 comprises a frame 44 that supports a pair of removable basket elements 46A, 46B, which can hold several types of utensils having various sizes and shapes.

Figure 3:
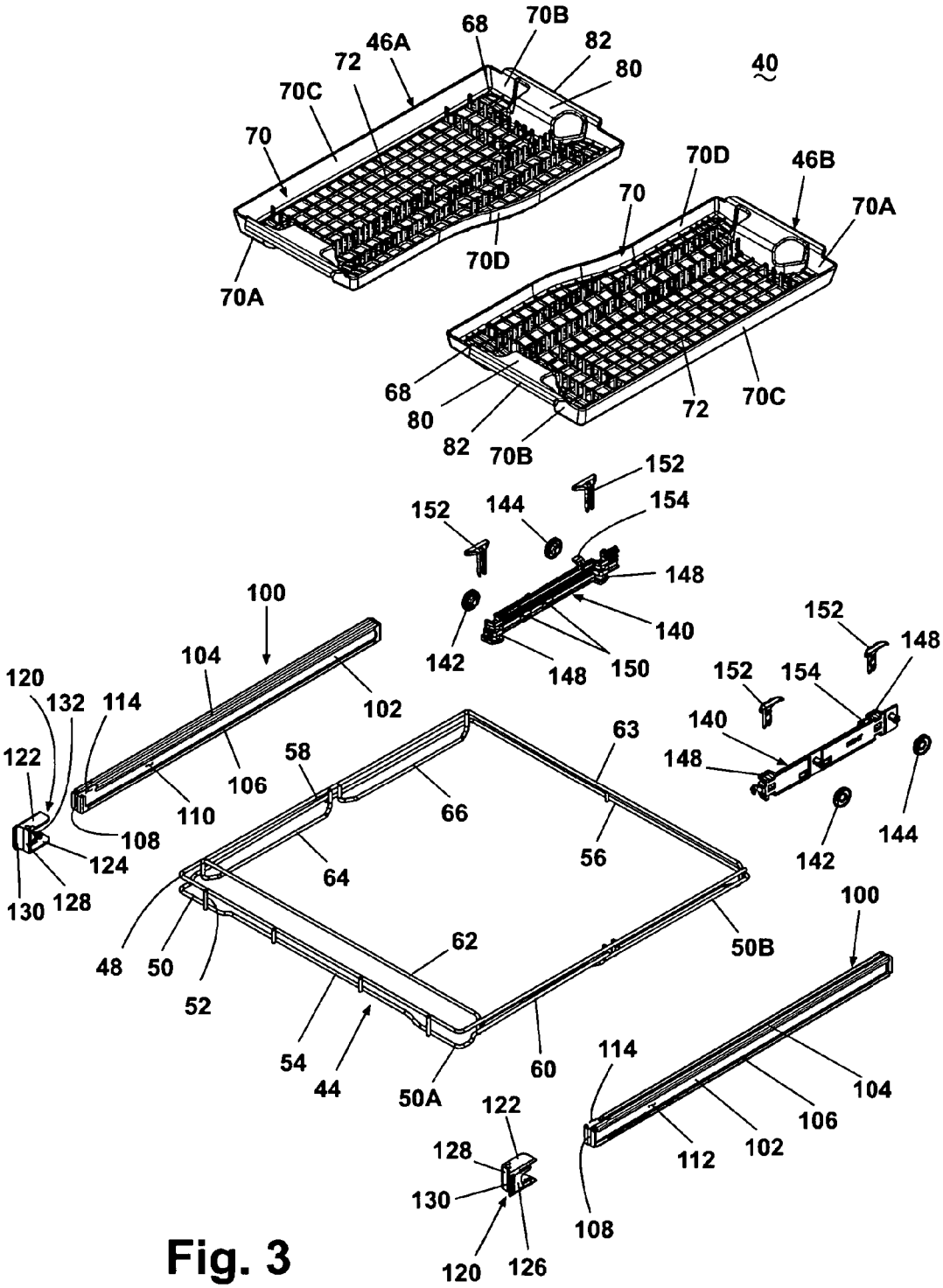
FIG. 3 is an exploded view of the slides and the third utensil rack of FIG. 2 according to one embodiment of the invention.

Referring now to FIG. 3, the frame 44 comprises an upper U-shaped wire 48 and a generally rectangular lower peripheral wire 50 joined by a plurality of spaced and generally vertical connecting wires 52. The peripheral wires 48, 50 form spaced front and rear ends 54, 56 connected by opposing sides 58, 60. The U-shaped wire 48 is oriented such that it opens at the rear end 56, and the lower peripheral wire 50 is formed by a pair of opposed, U-shaped front and rear lower peripheral wires 50A, 50B that join at the opposing sides 58, 60. The frame 44 further comprises a front upper support rail 62 and a rear upper support rail 63 that extend between and above the opposing sides 58, 60 of the upper peripheral wire 48 and are parallel to and spaced from the front end 54 and the rear end 56, respectively. Additionally, the frame 44 includes a first pair of opposing lower support rails 64 and a second pair of opposing lower support rails 66 on the opposing sides 58, 60 of the frame 44. The first pair of lower support rails 64 is integral with the front upper support rail 62, and, similarly, the second pair of lower support rails 66 is integral with the rear upper support rail 63. Each of the lower support rails 64, 66 is elongated and generally U-shaped and depends from the upper peripheral wire 48 such that it extends below the lower peripheral wire 50. Thus, the upper support rails 62, 63 are vertically spaced from the lower support rails 64, 66. The upper and lower peripheral wires 48, 50, the upper support rails 62, 63, and the lower support rails 64, 66 are preferably metal wires coated with polymeric materials that can withstand the environment of the wash chamber 24 and protect the metal wires from corrosion. Alternatively, the upper and lower peripheral wires 48, 50, the upper support rails 62, 63, and the lower support rails 64, 66 can be composed entirely of polymeric materials.

Figure 4:
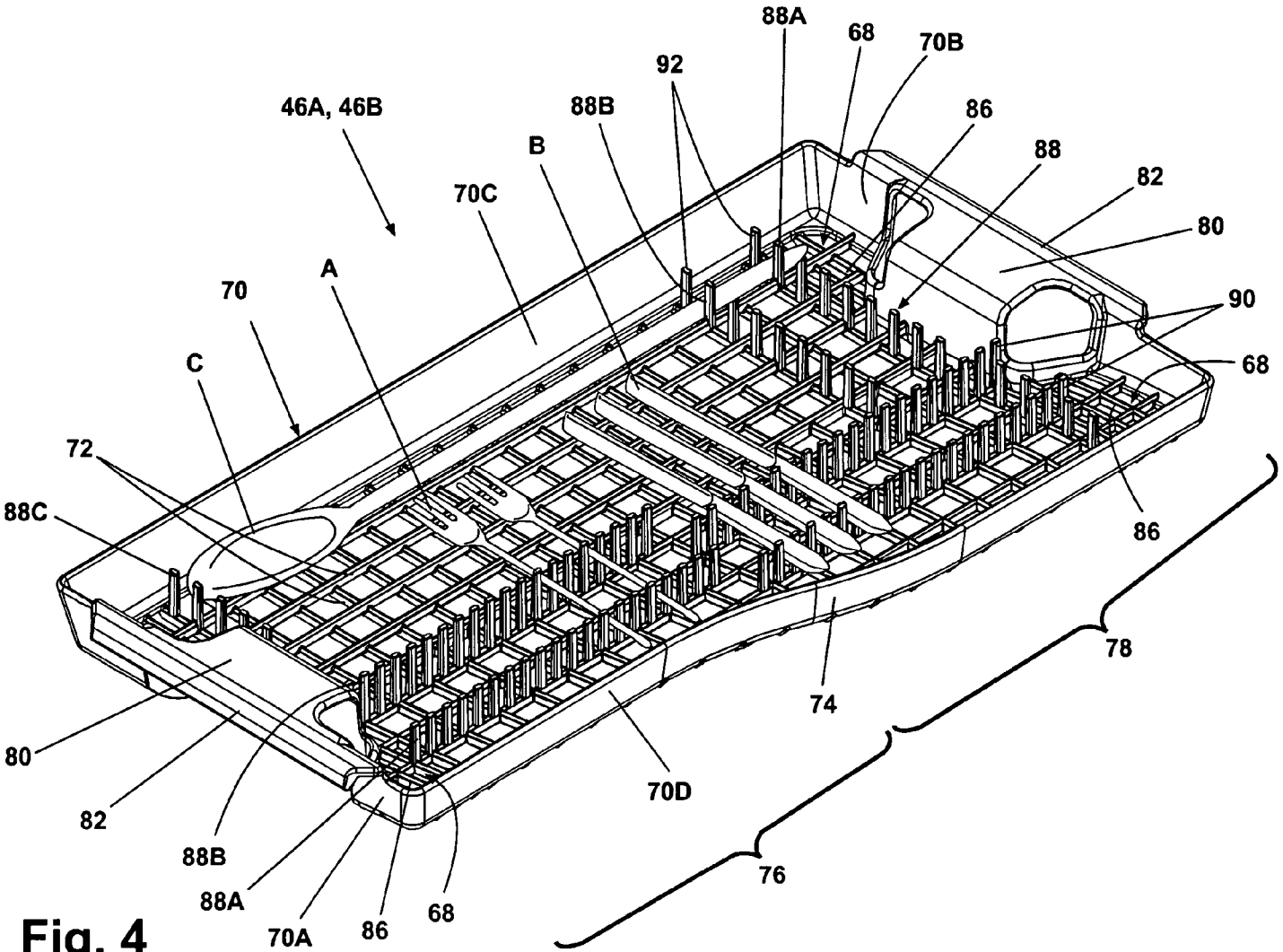
FIG. 4 is a perspective view of one of the basket elements of FIG. 2 according to one embodiment of the invention.

Referring now to FIG. 4, according to one embodiment of the invention, the basket elements 46A, 46B, which rest on the frame 44, each comprise an upstanding peripheral wall 70 and a grid formed by a plurality of intersecting ribs 72 that form a bottom wall surrounded by the peripheral wall 70. The intersecting ribs 72 are spaced from one another a distance suitable for holding utensils such as silverware, spatulas, and the like. Further, the bottom wall optionally includes at least one small item support area 68 comprising intersecting support ribs 86 that are spaced closer than the intersecting ribs 72 to support small items, such as corn cob holders, that can potentially fall between the intersecting ribs 72. As shown in FIG. 4, the small item support areas 68 are preferably located in corners of basket elements 46A, 46B, but they can be located in any suitable region of the bottom wall.

The peripheral wall 70 comprises parallel and spaced first and second edges 70A, 70B joined by spaced third and fourth edges 70C, 70D. Each of the first and second edges 70A, 70B are substantially straight and can include a carry handle 80 formed integrally therewith. Each of the handles can comprise a lateral hook or flange 82 sized to receive the upper and lower support rails 62, 63, 64, 66. The third edge 70C is generally straight and perpendicular to the first and second edges 70A, 70B, while the fourth edge 70D can comprise an intermediate curve 74 to form a first basket element portion 76 and a second basket element portion 78 that is wider than the first basket element portion 76. As a result of this configuration, utensils of different length can be efficiently arranged within the basket elements 46A, 46B. As shown in FIG. 4, relatively short utensils A, such as standard forks and spoons, can be placed in the first basket element portion 76 in an orientation parallel to the first and second edges 70A, 70B, while medium length utensils B, such as table knives, can fit in the second basket element portion 78 also in an orientation generally parallel to the first and second edges 70A, 70B. Additionally, the basket elements 46A, 46B are sized so that relatively long utensils C, such as spatulas, mixing spoons, chef knives, and the like, can be arranged across both the first and second basket element portions 76, 78 in an orientation parallel to the third edge 70C and generally perpendicular to the relatively short utensils A and the medium length utensils B. As illustrated in FIG. 4, the relatively long utensils C are longer than the medium length utensils B, which are longer than the relatively short utensils A. However, the utensils can be placed in any suitable location of the basket elements 46A, 46B. For example, the relatively short utensils A can be placed in the second basket element portion 78, if desired.

Each basket element 46A, 46B can further comprise a plurality of tines 88 projecting upward from the intersecting ribs 72 to support and separate individual utensils. The tines 88 can be arranged in groups so that the user can efficiently position utensils of different length in different areas of the basket elements 46A, 46B. A first tine group 90 extends along the fourth edge 70D for holding utensils in an orientation parallel to the first and second edges 70A, 70B, and a second tine group 92 is disposed along the second edge 70B for holding utensils in an orientation parallel to the third edge 70C. Preferably, the tines 88 in the first tine group 90 are spaced to hold relatively thin utensils, such as table knives, spoons, and forks (i.e., the relatively short utensils A and the medium length utensils B), while the tines 88 in the second tine group 92 are spaced farther apart to accommodate wider utensils, such as spatulas (i.e., the relatively long utensils C). Further, the tines 88 are preferably arranged in pairs of tines to form two parallel rows 88A, 88B of tines 88. As a result of this configuration, the utensils positioned between the tines 88 are held by the tines 88 at two locations along the length thereof, and, therefore, the rows 88A, 88B of tines 88 prevent pivotal movement of the utensils and maintain the utensils in the orientation generally parallel to the first and second edges 70A, 70B or parallel to the third edge 70C. Additionally, the second group of tines 92 includes a third row 88C of tines 88 along the first edge 70A for securing both ends of the relatively long utensils C to prevent the pivotal movement thereof.

Referring back to FIG. 2, according to one embodiment of the invention, the fourth edges 70D of the basket elements 46A, 46B are complementary and matingly abut one another when the basket elements 46A, 46B are seated on the frame 44. As a result, the first edges 70A, the second edges 70B, and the third edges 70C of both of the basket elements 46A, 46B form a generally rectangular periphery with a minor discontinuation at the interface between the basket elements 46A, 46B. Further, because the basket elements 46A, 46B are complementary, the basket elements 46A, 46B mate to form a whole, generally rectangular basket. The whole basket is defined by the rectangular periphery and has a surface area slightly less than the area defined between the front and rear ends 54, 56 and the opposing sides 58, 60 of the frame 44. In particular, the whole basket corresponds to a single basket sized to span in one direction between the upper support rails 62, 63 and in the other direction a distance slightly less than the distance between the first and second pairs of opposing lower support rails 64, 66. In the illustrated embodiment, the first basket element portion 76 of the first basket element 46A aligns with the second basket element portion 78 of the second basket element 46B, and the second basket element portion 78 of the first basket element 46A aligns with the first basket element portion 76 of the second basket element 46B to form the whole basket, which has a constant width equal to the sum of the individual widths of the basket element portions 76, 78. Preferably, the basket elements 46A, 46B are identical in shape and size so that each of the basket elements 46A, 46B accounts for about one half of the whole basket. Further, production costs are minimized when the basket elements 46A, 46B are identical because only a single mold design is required for all of the basket elements 46A, 46B.

Figure 5:
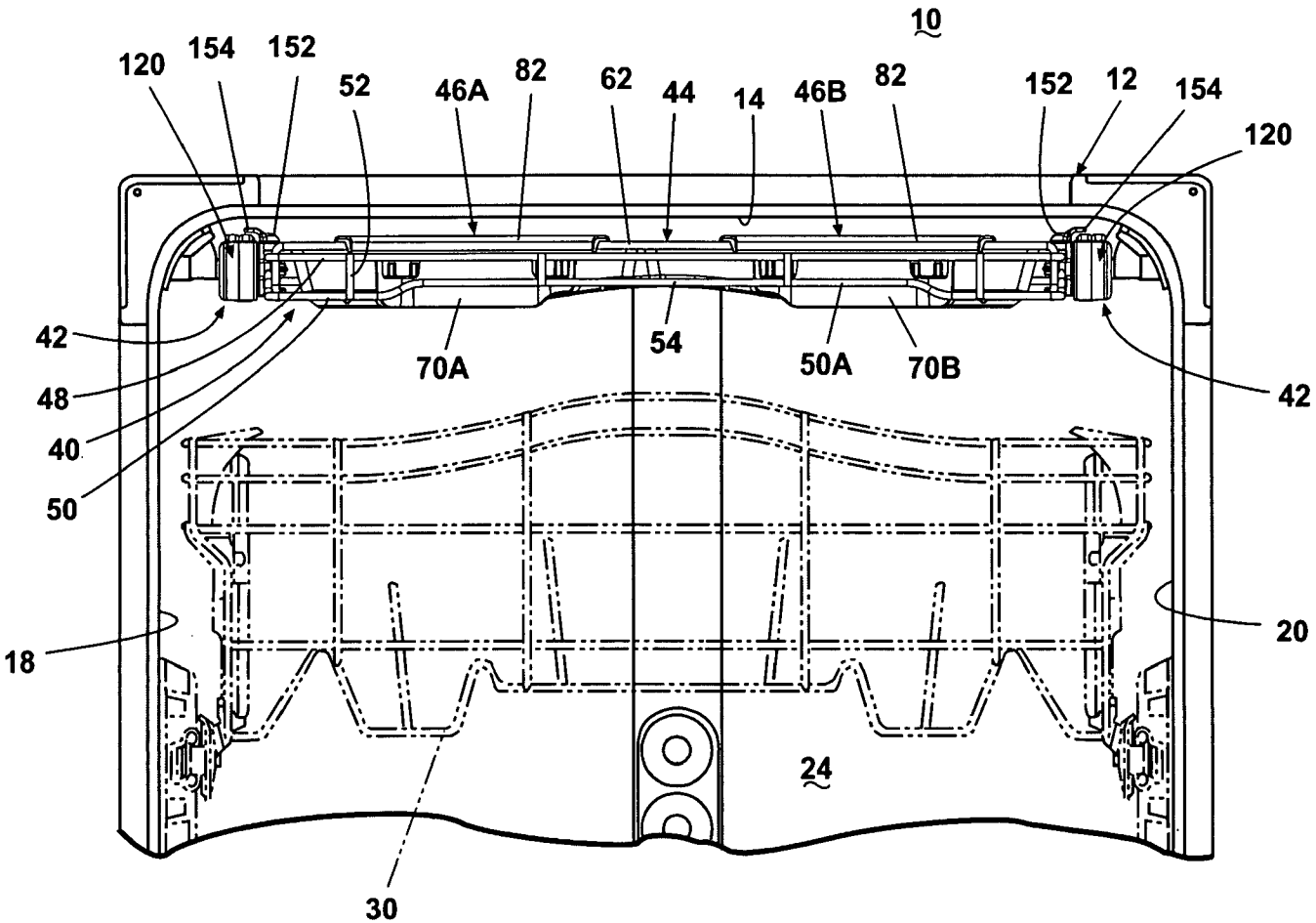
FIG. 5 is a front view of the dishwasher of FIG. 1, with a traditional upper rack shown in phantom for clarity, and the third utensil rack according to one embodiment of the invention shown in an upper position.
Figure 6:
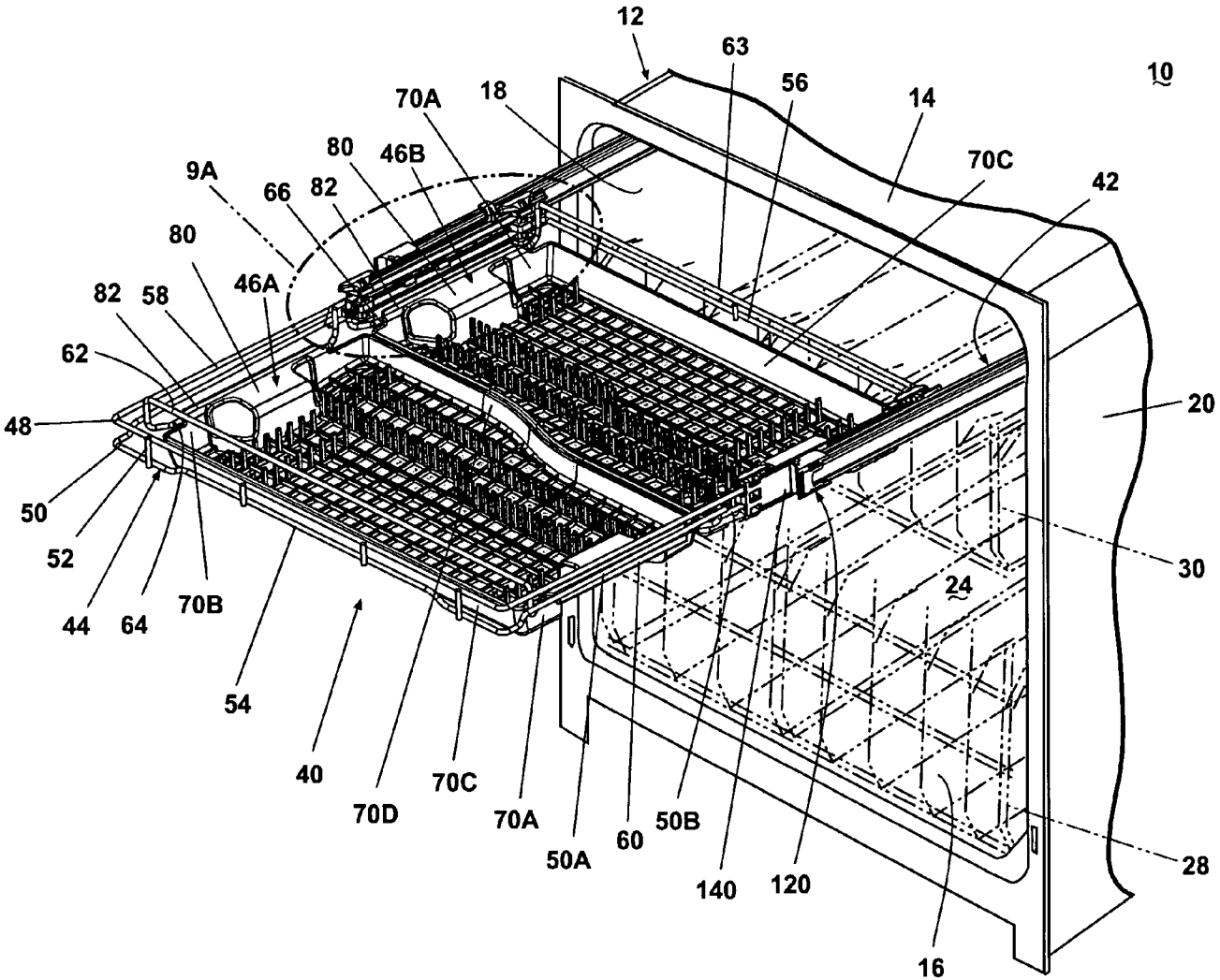
FIG. 6 is a perspective view of the dishwasher similar to FIG. 2, except that the basket elements are shown in a lower position on the frame.
Figure 7:
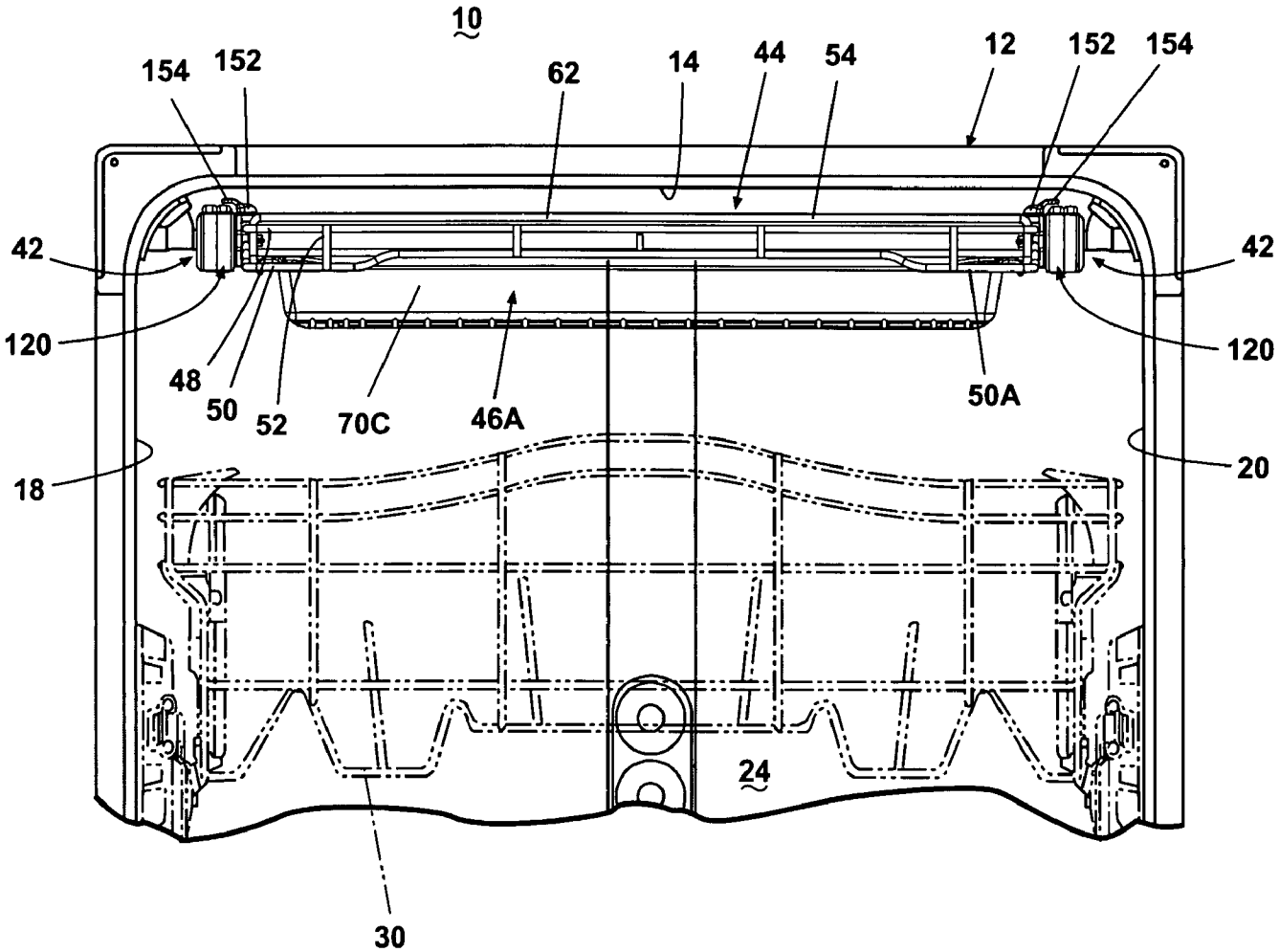
FIG. 7 is a front view of the dishwasher similar to FIG. 5, except that the basket elements are in the lower position on the frame.

The basket elements 46A, 46B are adjustably mounted to the frame 44 to accommodate utensils held by the second utensil rack 30 and utensils held by the basket elements 46A, 46B and to efficiently utilize the limited space in the wash chamber 24. In particular, the basket elements 46A, 46B can be vertically adjustable on the frame 44 and, therefore, within the wash chamber 24. As shown in FIGS. 2 and 5, according to one embodiment of the invention, the basket elements 46A, 46B can be mounted in an upper position wherein the flanges 82 on the first and second edges 70A, 70B rest on the upper support rails 62, 63. As shown in FIGS. 6 and 7, according to one embodiment of the invention, the basket elements 46A, 46B can be mounted in a lower position, wherein the flanges 82 on the first and second edges 70A, 70B rest on the first and second pairs of opposing lower support rails 64, 66. A comparison of FIGS. 5 and 7 shows that the basket elements 46A, 46B are located higher in the wash chamber 24 when in the upper position. Further, the bottom walls formed by the intersecting ribs 72 of the basket elements 46A, 46B are spaced from the second utensil rack 30 a greater distance when the basket elements 46A, 46B are in the upper position than when the basket elements 46A, 46B are in the lower position, but clearance between the bottom walls and the upper wall 14 of the cabinet 12 is greater when the basket elements 46A, 46B are in the lower position than when in the upper position. Mounting the basket elements 46A, 46B in the upper and the lower positions is, therefore, a compromise between spacing between the second utensil rack 30 and the third utensil rack 40 and clearance between the third utensil rack 40 and the upper wall 14 of the cabinet 12. Additionally, the basket elements 46A, 46B in the upper position are oriented generally orthogonal to the basket elements 46A, 46B in the lower position because the portions of the frame 44 that support the basket elements 46A, 46B in these two positions are oriented orthogonal to one another. Such an arrangement facilitates mounting the basket elements 46A, 46B to the frame 44 since the upper support rails 62, 63 do not interfere with the basket elements 46A, 46B when mounting them on the first and second pairs of opposing lower support rails 64, 66 and vice-versa.

Figure 8:
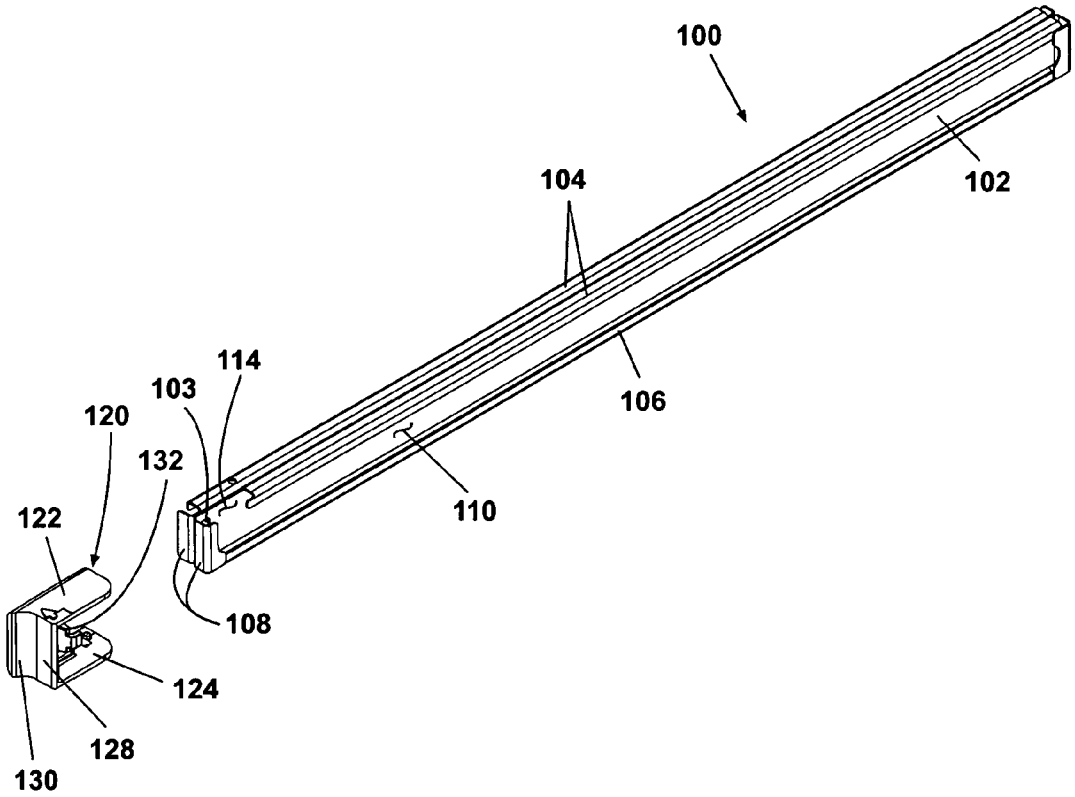
FIG. 8 is an enlarged exploded view of a track and closure of the slides of FIG. 3 according to one embodiment of the invention.
Figure 9A:
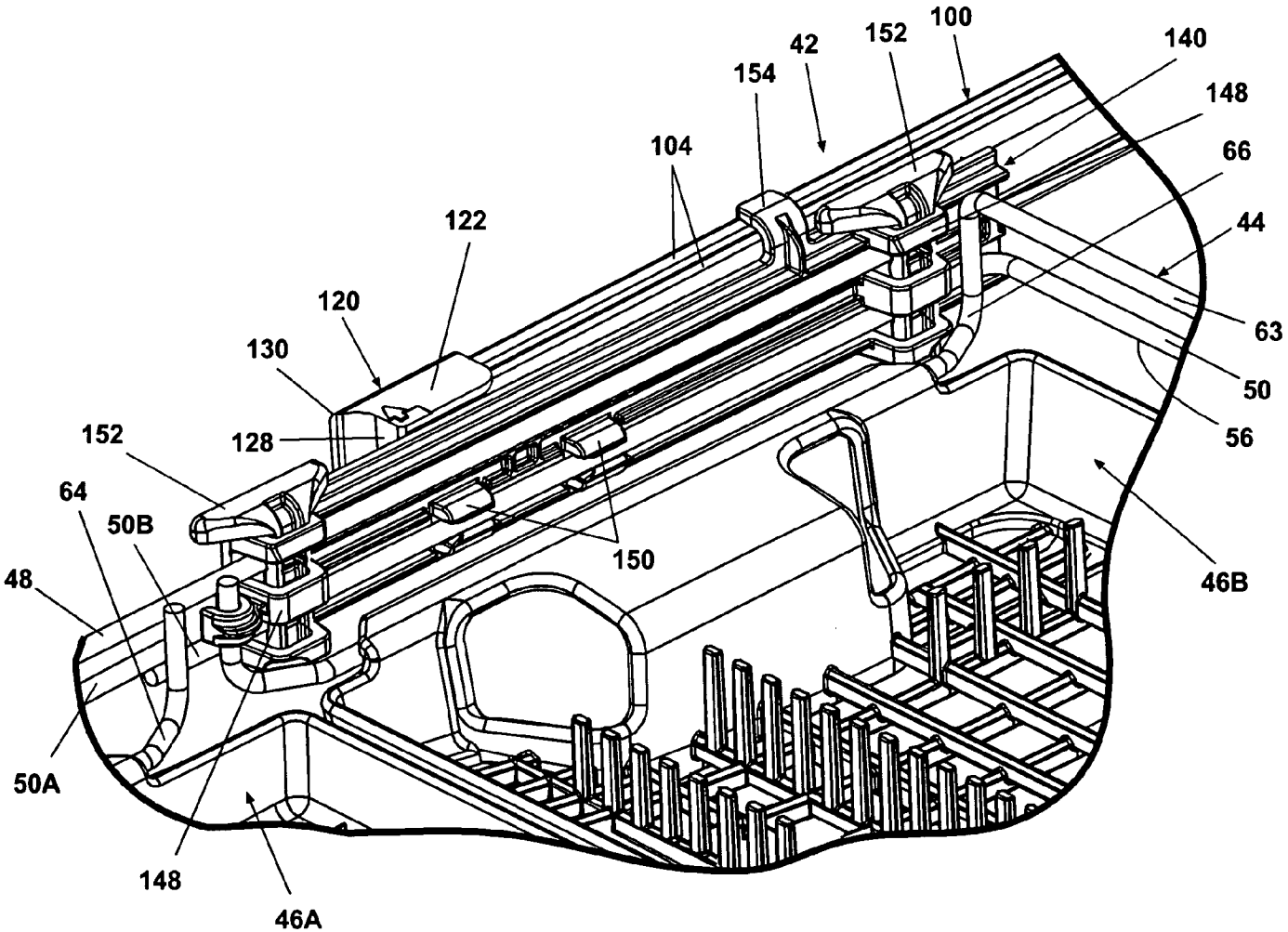
FIG. 9A is enlarged view of the region labeled 9A in FIG. 6 with the closure on the slide shown in a closed position.
Figure 9B:
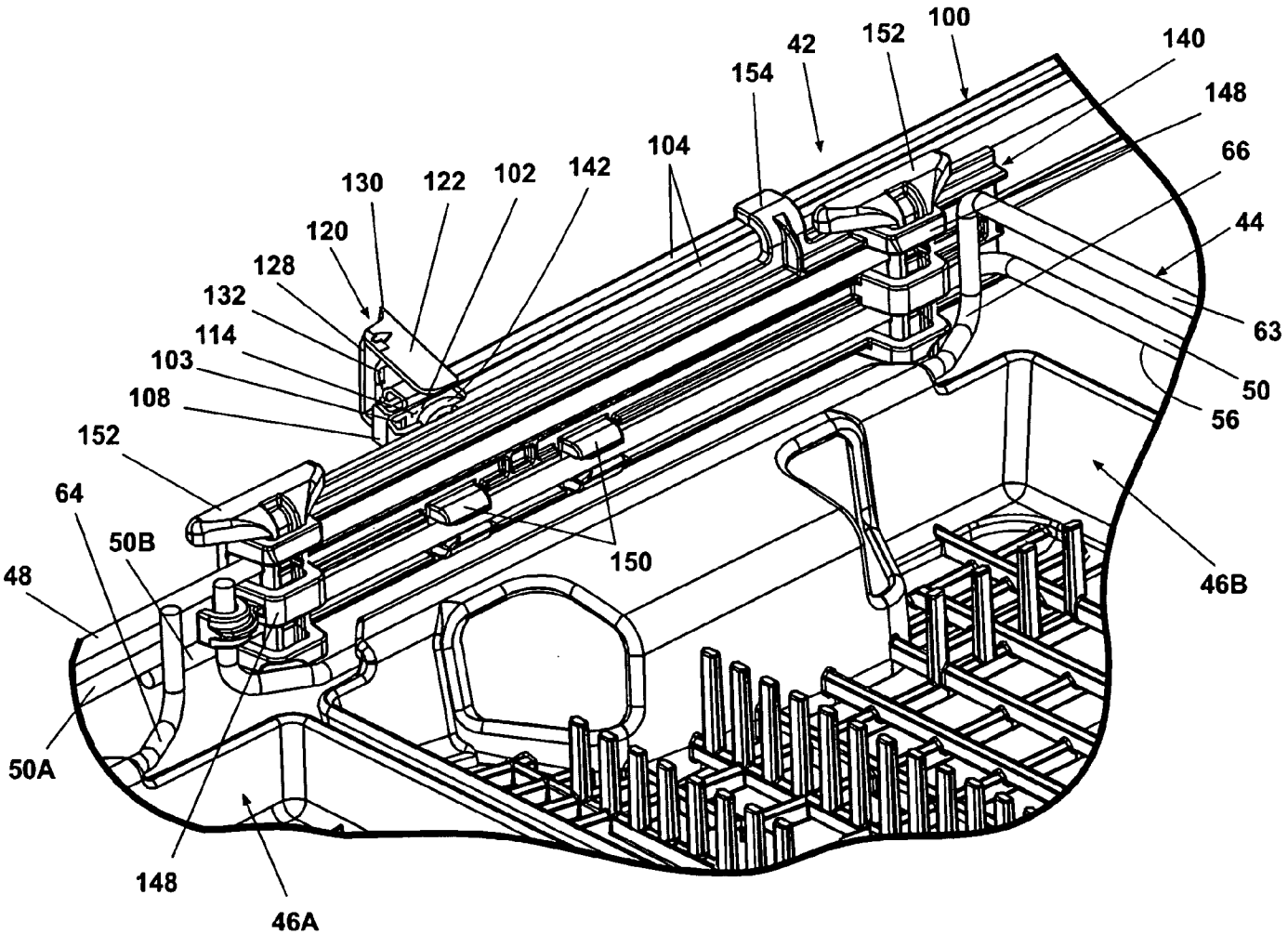
FIG. 9B is enlarged view similar to FIG. 9A, except that the closure on the slide is shown in an opened position and a wheel on the third rack is aligned with an access opening in the top of the slide.

Referring particularly to FIG. 8 and generally to FIG. 3, the slides 42 that slidably mount the third utensil rack 40 to the cabinet 12 each comprise a track 100 having a generally vertical middle wall 102 with an aperture 103 near a front end thereof and pairs of upper and lower L-shaped flanges 104, 106 extending along the middle wall 102 to define an inner raceway 110 on an interior side (i.e., the side closer to the third utensil rack 40) of the middle wall 102 and an outer raceway 110 on an outer side (i.e., the side farther from the third utensil rack 40) of the middle wall 102. The raceways 110, 112 terminate at a pair of stops in the form of front flanges 108 at the front end of the track 100. The upper flange 104 that partially defines the inner raceway 110 is spaced from the front flange 108 on the interior side of the middle wall 102 to form an access opening 114 therebetween. A closure 120 pivotally mounted to the upper and lower flanges 104, 106 of the track 100 selectively blocks the access opening 114. The closure 120 comprises parallel upper and lower walls 122, 124 joined by a side wall 126 and a front wall 128 orthogonal to the side wall 126. The side wall 126 and the front wall 128 form a grip 130 sized to be grasped between a user's fingers for pivotally moving the closure 120. Additionally, the closure 120 includes a detent 132 that extends from the side wall 126 and is sized to mate with the aperture 103. The closure 120 is movable between a closed position, as shown in FIG. 9A, wherein the upper wall 122 blocks the access opening 114, and an opened position, as illustrated in FIG. 9B, wherein the closure 120 is pivoted away from the track 100 so that the upper wall 122 is spaced from the access opening 114.

Figure 10:
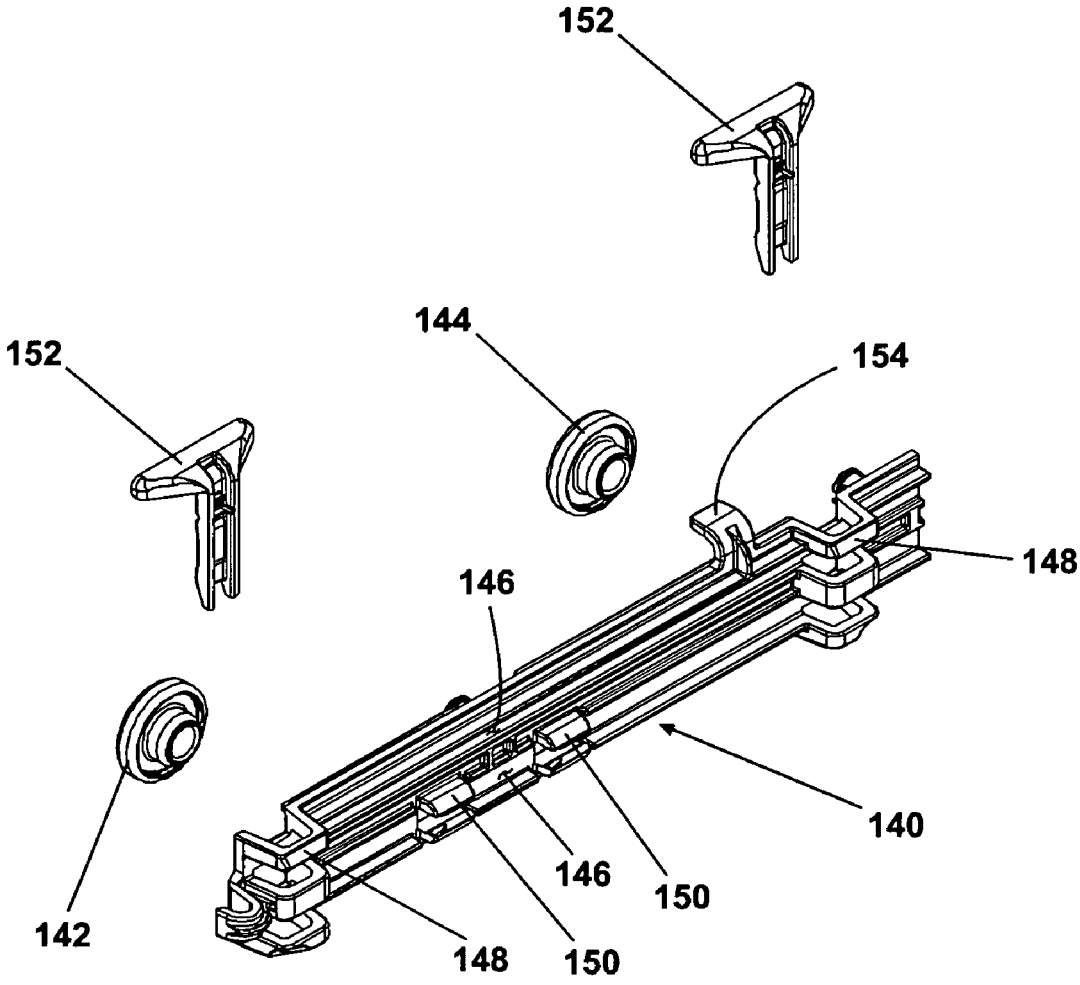
FIG. 10 is an enlarged perspective view of a wheel support from the third utensil rack of FIG. 3 according to one embodiment of the invention.

Referring particularly to FIG. 10 and generally to FIG. 3, a wheel support 140 couples each opposing side 58, 60 of the third utensil rack 40 to its corresponding slide 42. Each wheel support 140 is an elongated, generally rectangular member with front and rear wheels 142, 144 rotatably mounted to an outer side thereof. The wheels 142, 144 are sized for receipt within the access opening 114 and the inner raceway 110. The wheel support 140 further includes a pair of parallel grooves 146 on an interior side thereof for receiving the upper and lower peripheral wires 48, 50 of the frame 44. Snap clamps 150 adjacent the grooves 146 are sized to securely receive at least one of the upper and lower peripheral wires 48, 50 to prevent lateral translation of the wheel support 140 relative to the frame 44. Additionally, the interior side of the wheel support 140 includes sets of vertically aligned U-shaped projections 148 between the grooves 146 sized to receive brackets 152 for sandwiching the frame 44 between the wheel support 140 and the brackets 152 to thereby mount the wheel support 140 to the frame 44. The wheel support 140 also comprises an upwardly and outwardly extending overhang 154 to facilitate mounting the wheel support 140 to the track 100.

An exemplary description of the assembly and operation of the third utensil rack 40 and the slides 42 follows. It will be apparent to one of ordinary skill that the assembly and operation can proceed in any logical order and is not limited to the sequence presented below. The following description is for illustrative purposes only and is not intended to limit the invention in any way.

Figure 11:
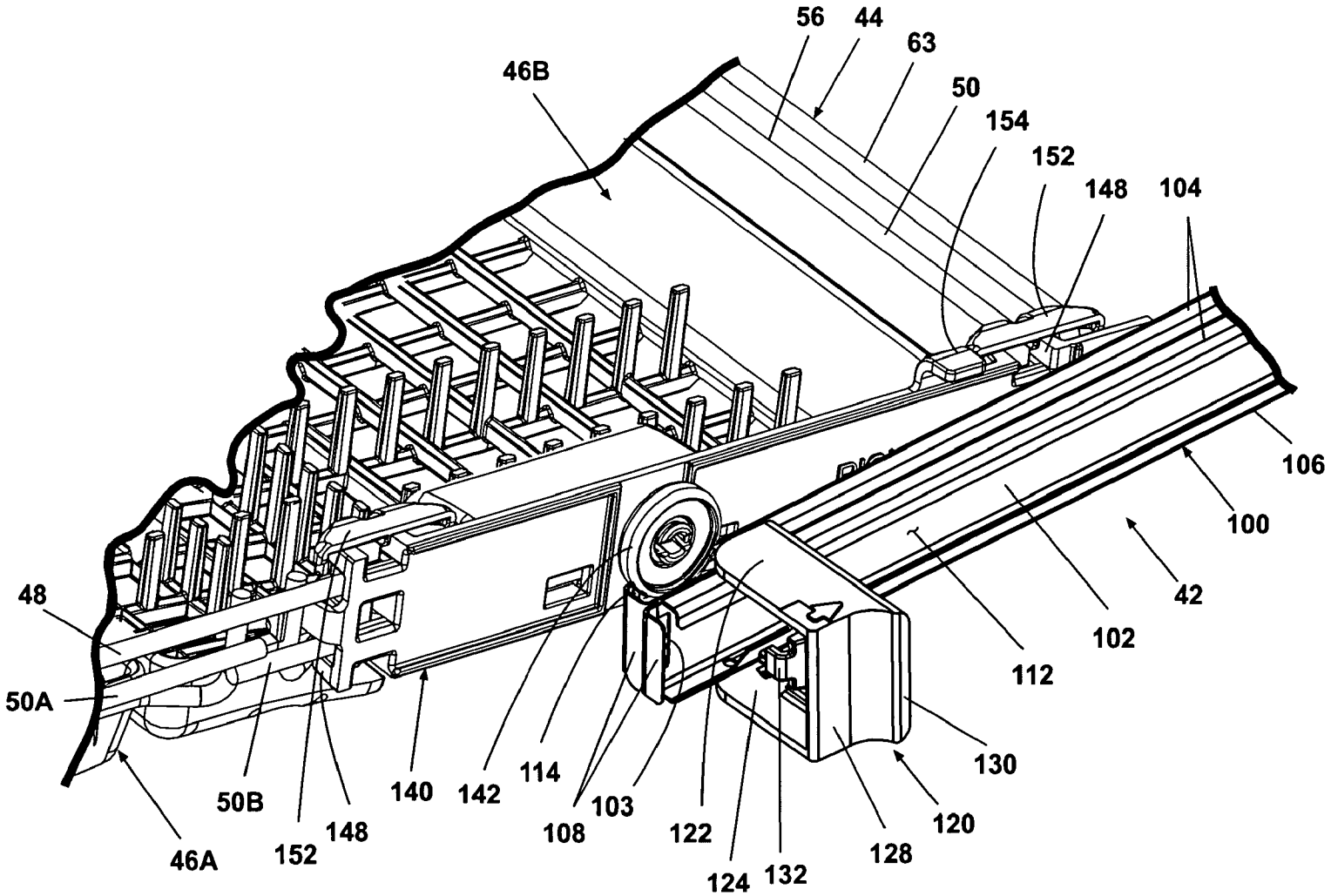
FIG. 11 is an enlarged perspective view similar to FIG. 9B with the wheel being removed from the slide through the access opening according to one embodiment of the invention.

Each of the slides 42 is mounted to the dishwasher 10 by attaching the track 100 to a conventional slide mount (not shown) on the corresponding opposing side wall 18, 20. Typically, the track 100 receives the slide mount within the outer raceway 112 so that the track 100 can slide relative to the cabinet 12. Next, the wheel supports 140 are mounted to the opposing sides 58, 60 of the frame 44 by aligning the upper and lower peripheral wires 48, 50 with the grooves 146, snapping the lower peripheral wire 50 into the snap clamps 150, and inserting the brackets 152 into the projections 148 to clamp the upper and lower peripheral wires 48, 50 between the wheel support 140 and the brackets 150. After the wheel supports 140 are secured to the frame 44, the user pivots the closures 120 on the slides 42 to the opened position so that the rear wheels 144 can be inserted into the inner raceways 110 through the access openings 114. The user then pushes the frame 44 towards the wash chamber 24 so that the rear wheels 144 travel along the inner raceway 110 until the front wheels 142 are aligned with the access openings 114, as shown in FIG. 11. After the user inserts the front wheels 142 into the inner raceway 110 through the access openings 114, the user pivots the closures 120 toward the track 100 to the closed position, wherein the detents 132 mate with the apertures 103, and the upper walls 122 block the access openings 114 to prevent inadvertent removal of the front wheels 142 from the inner raceways 110, as shown in FIG. 9A. In this position, the overhangs 154 of the wheel supports 140 rest on the upper flanges 104 of the track 100 to help support the frame 44 on the slides 42. When the slides 42 are mounted to the cabinet 12 and the frame 44 is mounted to the slides 42, the third utensil rack 40 is thereby mounted to the dishwasher 10 and can slide relative to the wash chamber 24.

The user can mount the basket elements 46A, 46B to the frame 44 in either the upper position or the lower position depending on the desired configuration of the utensil racks 28, 30, 40 in the wash chamber 24, the sizes of the utensils in the second utensil rack 30, and the sizes of the utensils to be held in the third utensil rack 40. To maximize the space between the second utensil rack 30 and the basket elements 46A, 46B, the basket elements 46A, 46B are placed adjacent one another in the upper position, as shown in FIGS. 2 and 5, with the flanges 82 on the upper support rails 62, 63. Further, the basket elements 46A, 46B are positioned with their complementary, fourth edges 70D in abutting contact to form the whole basket. However, if the user desires to maximize the clearance between the basket elements 46A, 46B and the upper wall 14 of the cabinet 12 to fit larger utensils in the third utensil rack 40, the basket elements 46A, 46B are rotated 90-degrees and placed adjacent one another in the lower position, as illustrated in FIGS. 6 and 7, with the flanges 82 on the first and second opposing pairs of lower support rails 64, 66. As in the upper position, the basket elements 46A, 46B are positioned with their complementary, fourth edges 70D in abutting contact to form the whole basket.

With the basket elements 46A, 46B in either the upper position or the lower position, the user can fill the basket elements 46A, 46B with various shapes and sizes of utensils, including the relatively short utensils A, the medium length utensils B, and the relatively long utensils C, as described above. The utensils can be arranged in the basket elements 46A, 46B in any suitable fashion to maximize the quantity of utensils held by the third utensil rack 40 without compromising the ability of the dishwasher 10 to clean the utensils. Additionally, the user can place small items, such as corn cob holders, in the small item support areas 68. During operation of a wash cycle, the tines 88 surrounding the small item support areas 68 help retain the small items in the small item support areas 68.

After the wash cycle is complete, the user pulls the third utensil rack 40 from the wash chamber to empty the basket elements 46A, 46B. The front stop flanges 108 limit the forward movement of the frame 44 relative to the slides 42. Next, the user removes the utensils from the third utensil rack 40 in any suitable manner. For example, the user can either manually remove each utensil from the basket elements 46A, 46B while the basket elements 46A, 46B are mounted to the frame 44, the user can remove at least one of the basket elements 46A, 46B with the utensils therein and empty the at least one basket element 46A, 46B at a location separate from the dishwasher 10, or the user can remove at least one of the basket elements 46A, 46B with the utensils therein and use the at least one basket element 46A, 46B for utensil storage, such as by placing the at least one basket element 46A, 46B in a drawer.

If the user desires to remove the entire frame 44 from the dishwasher, the user pivots the closures 120 away from the tracks 100 to the opened position, as shown in FIG. 9B, to unblock the access openings 114. Next, the user aligns the front wheels 142 with the access openings 114 and lifts the frame 44 to thereby lift the front wheels 142 through the access openings 114, as illustrated in FIG. 11. Thereafter, the user pulls the frame 44 further from the wash chamber 24 until the rear wheels 144 are aligned with the access openings 114 and lifts the frame 44 to thereby lift the rear wheels 144 through the access openings 114 and disconnect the frame 44 from the slides 42.

Figure 12:
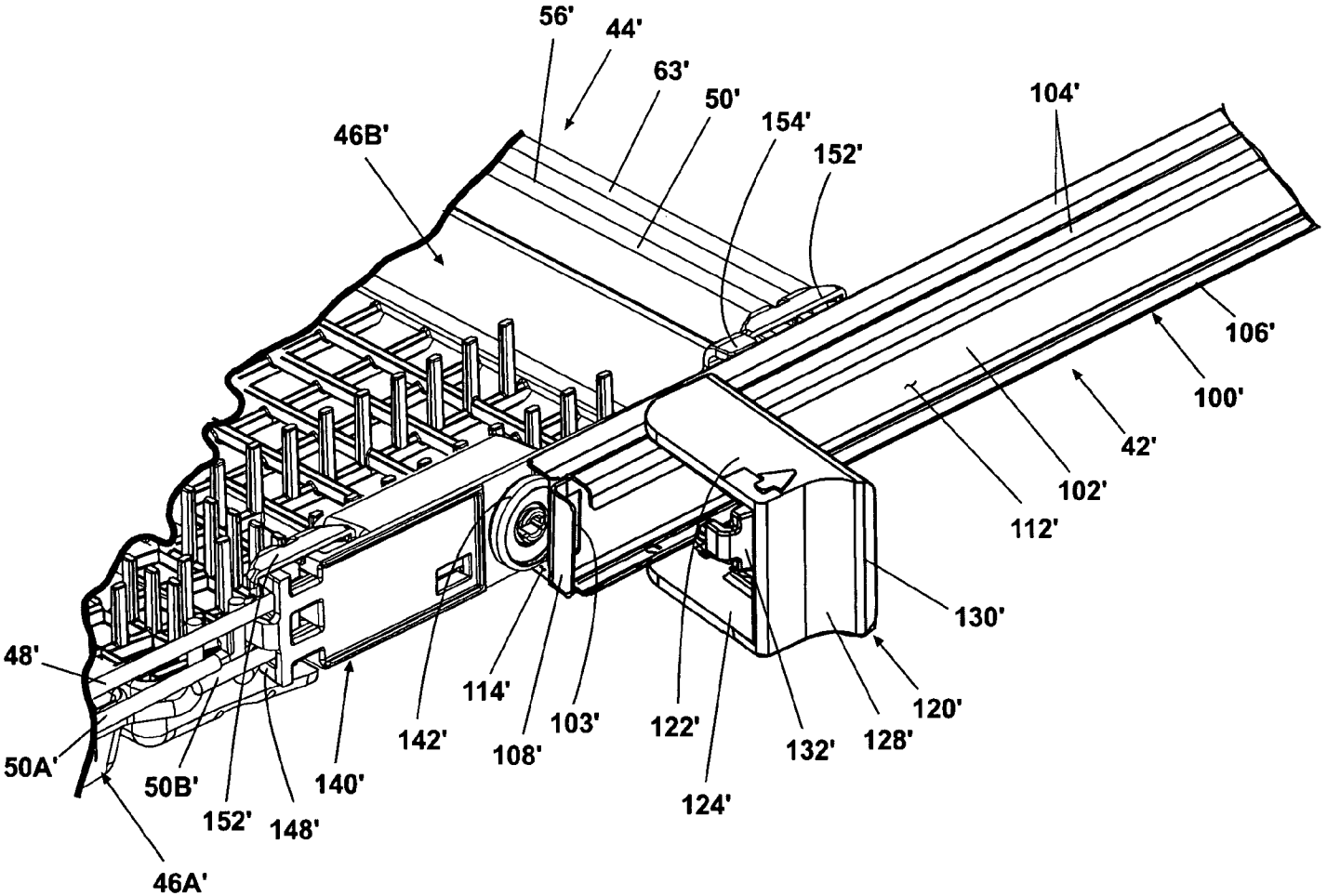
FIG. 12 is an enlarged perspective view of an alternative slide according to one embodiment of the invention having an access opening at the end of the slide.

An alternative slide 42' is illustrated in FIG. 12, where components similar to those of the first embodiment slide 42 are identified with the same numeral bearing a prime (') symbol. The slide 42' is substantially identical to the first embodiment slide 42, except that the track 100' does not include the front flange stops 108, and the upper and the lower flanges 104', 106' extend all the way to the end of the track 100'. As a result, the access opening 114' is defined between the ends of the upper and lower flanges 104', 106', and the closure 120'in the closed position functions as the stop while blocking the access opening 114'.

Alternatively, the access opening 114 can be located elsewhere in the track 100. For example, the access opening 114 can be formed between the lower flange 106 and the front flange stop 108 if the lower flange 106 is sufficiently spaced from the front end of the track 100.

The complementary basket elements 46A, 46B have been described with respect to the number, shape, and size shown in the figures. However, it is within the scope of the invention for the whole basket to be formed by more than two basket elements and for the basket elements to be shaped and sized in any suitable manner as long as they are complementary and together form the whole basket. For example, the whole basket can be formed by two or more rectangular basket elements having straight edges, a first L-shaped basket element and a second square or rectangular basket element, two triangular basket elements, or basket elements similar to the basket elements 46A, 46B but having a fourth edge 70D with a different contour. Additionally, the basket elements 46A, 46B are not limited to use with the frame 44; the basket elements 46A, 46B can be utilized with any suitable frame or utensil rack and are not required to be vertically adjustable within the wash chamber 24. Similarly, the frame 44 can mount a unitary whole basket rather than separate basket elements so that the unitary whole basket is vertically adjustable within the wash chamber 24.

While the third utensil rack 40 has been shown and described as being located near the upper wall 14 of the cabinet 12 and in conjunction with the first and the second utensil racks 28, 30, it is within the scope of the invention to utilize the third utensil rack 40 in any location within the wash chamber 24, such as adjacent the lower wall 16 or in the middle of the wash chamber 24, and with or without other utensil racks. Furthermore, the slides 42 are not limited for use with the third utensil rack 40; rather, the slides 42 can be used with the first utensil rack 28, the second utensil rack 30, or any other suitable utensil rack.

The grid of the basket elements 46A. 46B has been described as being formed by the plurality of intersecting ribs 72; however, it is within the scope of the invention for the grid to be formed by other structures having apertures or gaps that allow wash liquid to pass through the bottom wall of the basket elements 46A, 46B. For example, the grid can be a molded panel with circular, rectangular, or other shaped apertures formed therein.

While the third utensil rack 40 and the slides 42 have been described and shown as for use in the dishwasher 10 comprising the cabinet 12 and the door 26 movably mounted to the cabinet 12, the dishwasher 10 can be any type of appliance for washing dishes and is not limited to the dishwasher 10 shown in the figures. For example, the dishwasher can be a drawer-type dishwasher, wherein the wash chamber is formed in an open-top drawer that is slidably mounted to a cabinet. Further, the slides 42 can be used to slidably mount the drawer to the cabinet, if desired.

The third utensil rack 40 accommodates various shapes and sizes of utensils for effective cleaning thereof without dramatically sacrificing capacity of the first and second utensil racks 28, 30. Because the basket elements 46A, 46B are vertically adjustable, the third utensil rack 40 can be arranged to accommodate the sizes of utensils in the second utensil rack 30. In the preferred embodiment, various portions of the frame 44, such as the upper support rails 62, 63 and the lower support rails 64, 66, function as height adjusters for adjustably mounting the basket elements 46A, 46B to the frame 44. However, the height adjusters can also be located on the basket elements 46A, 46B. For example, the basket elements 46A, 46B can include multiple hooks vertically spaced on the peripheral wall 70 such that the basket elements 46A, 46B can be mounted to a portion of the frame 44 in different vertical orientations depending on which hooks mate with the portion of the frame 44.

While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic dishwasher comprising:

an open-faced cabinet defining a wash chamber;

a door movably mounted to the cabinet for selectively closing the wash chamber; and a utensil rack mounted within the wash chamber and comprising:

a frame mounted to the cabinet;

a basket selectively mounted to the frame between a first rotational orientation and a second rotational orientation, different than the first rotational orientation; and a height adjuster operably coupling the basket and the frame and configured such that when the basket is in the first rotational orientation, the basket is at a first position in the wash chamber, and when the basket is in the second rotational orientation, the basket is at a second position in the wash chamber, with the basket being located higher in the wash chamber in the second position than in the first position, whereby the height of the basket within the wash chamber may be adjusted by moving the basket between the first and second rotational orientations.

2. The automatic dishwasher according to claim 1, wherein the height adjuster comprises a portion of the frame.

3. The automatic dishwasher according to claim 2, wherein the portion of frame comprises a lower support for supporting the basket in the first position and an upper support located vertically above the lower support for supporting the basket in the second position.

4. The automatic dishwasher according to claim 3, wherein the lower support and the upper support are perpendicular to one another.

5. The automatic dishwasher according to claim 3, wherein the frame is a wire frame.

6. The automatic dishwasher according to claim 5, wherein each of the lower support and the upper support comprises a pair of spaced support rails.

7. The automatic dishwasher according to claim 6, wherein the basket comprises outwardly extending flanges sized to rest on the support rails of the lower support and the upper support to hold the basket in the first and the second positions.

8. The automatic dishwasher according to claim 3, wherein the basket comprises hooks for mounting the basket to the lower support when the basket is in the first position and to the upper support when the basket is in the second position.

9. The automatic dishwasher according to claim 1, and further comprising:

a pair of slides, each slide defining an elongated raceway and mounted to the cabinet at opposite sides of the wash chamber;

a pair of wheels, each wheel mounted to an opposite side of the frame and received within the corresponding raceway to slidably mount the frame to the slides;

each slide having an access opening through which the wheel can be inserted and removed; and a closure movable between an open and a closed position for selectively closing the access opening to prevent the removal of the wheel from the raceway.

10. The automatic dishwasher according to claim 9, wherein the closure is pivotally mounted to the track to pivot between the open and closed positions.

11. The automatic dishwasher according to claim 9, wherein the closure comprises a detent for locking the closure in the closed position.

12. The automatic dishwasher according to claim 1, wherein the utensil rack is mounted near a top wall of the cabinet.

13. The automatic dishwasher according to claim 1, wherein the basket comprises a plurality of basket elements that are complementary to form the basket.

14. The automatic dishwasher according to claim 1, wherein the automatic dishwasher further comprises a middle rack mounted within the wash chamber and a lower rack mounted within the wash chamber below the middle rack.

15. The automatic dishwasher according to claim 14, wherein the utensil rack, the middle rack, and the lower rack are spaced relative to teach other and the cabinet such that the middle rack and lower rack may carry utensils positioned either horizontally or vertically and the utensil rack may carry utensils positioned horizontally and not vertically.

16. A utensil rack for use in an automatic dishwasher comprising an open-faced cabinet defining a wash chamber and a door movably mounted to the cabinet for selectively closing the wash chamber; the utensil rack comprising:

a frame mounted to the cabinet;

a basket selectively mounted to the frame between a first rotational orientation and a second rotational orientation, different than the first rotational orientation; and a height adjuster operably coupling the basket and the frame such that when the basket is in the first rotational orientation, the basket is at a first position in the wash chamber, and when the basket is in the second rotational orientation, the basket is at a second position in the wash chamber, with the basket being located higher in the wash chamber in the second position than in the first position, whereby the height of the basket within the wash chamber may be adjusted by moving the basket between the first and second rotational orientations.

17. The utensil rack according to claim 16 and further comprising a height adjuster for mounting the basket to the frame in the first position and in the second position.

18. The utensil rack according to claim 17, wherein the height adjuster comprises a portion of the frame.

19. The utensil rack according to claim 18, wherein the portion of frame comprises a lower support for supporting the basket in the first position and an upper support located vertically above the lower support for supporting the basket in the second position.

20. The utensil rack according to claim 19, wherein each of the lower support and the upper support comprises a pair of spaced support rails.

21. The utensil rack according to claim 20, wherein the basket comprises outwardly extending flanges sized to rest on the support rails of the lower support and the upper support to hold the basket in the first and the second positions.

22. The utensil rack according to claim 19, wherein the basket comprises hooks for mounting the basket to the lower support when the basket is in the first position and to the upper support when the basket is in the second position.

23. A utensil rack for use in an automatic dishwasher comprising an open-faced cabinet defining a wash chamber and a door movably mounted to the cabinet for selectively closing the wash chamber, the utensil rack comprising:

a frame mounted to the cabinet and having a periphery that defines an area; and a plurality of basket elements comprising at least a first basket element and a second basket element, and each of the first and second basket elements has a first portion with a first width and a second portion with second width that is greater than the first width;

wherein the basket elements are complementary to form a whole basket having a surface area that is slightly less than the area of the frame when the basket elements are arranged such that the first portion of the first basket aligns with the second portion of the second basket, and a surface area greater than the area of the frame when the basket elements are arranged such that the second portion of the first basket is aligned with the second portion of the second basket.

24. The utensil rack according to claim 23, wherein the first portion of the first basket element aligns with the second portion of the second basket element and the second portion of the first basket element aligns with the first portion of the second basket element to form the whole basket.

25. The utensil rack according to claim 23 wherein the basket elements together form a generally rectangular periphery for the whole basket.

26. The utensil rack according to claim 23, wherein the basket elements are substantially identical in their peripheral shape.

27. The utensil rack according to claim 23, wherein at least one of the basket elements comprises a bottom wall and a plurality of tines extending upward from the bottom wall for holding utensils therebetween.

28. The utensil rack according to claim 27, wherein the tines comprise a first group of tines, wherein the tines are spaced from one another a first distance to hold utensils sized to fit within the first distance, and a second group of tines, wherein the tines are spaced from one another a second distance greater than the first distance to hold utensils sized to fit within the second distance.

29. The utensil rack according to claim 28, wherein the first group of tines is generally perpendicular to the second group of tines.

30. The utensil rack according to claim 23, wherein at least one of the basket elements comprises a bottom wall formed by spaced intersecting ribs and a small item support area formed by intersecting support ribs spaced closer than the intersecting support ribs of the rest of the bottom wall.

* * * * *